United States Patent [19]

Yamazaki

[11] 4,025,054

[45] May 24, 1977

[54] ARMS FOR PANTOGRAPH JACK

[75] Inventor: Shinichiro Yamazaki, Toyota, Japan

[73] Assignee: Aisin Seiki Kabushiki Kaisha, Kariya, Japan

[22] Filed: May 8, 1975

[21] Appl. No.: 575,486

[30] Foreign Application Priority Data

May 8, 1974 Japan ..... 49-52650[U]

[52] U.S. Cl. ..... 254/126

[51] Int. Cl.[2] ..... B66F 3/12

[58] Field of Search ..... 254/122, 126

[56] References Cited

UNITED STATES PATENTS 1,714,464 5/1929 Merriman ..... 254/126

2,580,829 1/1952 Peck ..... 254/126

FOREIGN PATENTS OR APPLICATIONS 302,091 10/1932 Italy ..... 254/126

*Primary Examiner*—Al Lawrence Smith
*Assistant Examiner*—Robert C. Watson
*Attorney, Agent, or Firm*—Oblon, Fisher, Spivak, McClelland & Maier

[57] ABSTRACT

A pantograph jack having two pairs of arms includes gear teeth portions on one end of each of the arms. The gear teeth portions are formed on flange portions of the one end of each of the arms, and the flange portions are formed integrally with the arms each extending at a right angle therefrom.

1 Claim, 7 Drawing Figures

ARMS FOR PANTOGRAPH JACK

BACKGROUND OF THE INVENTION

1. Field of the Invention

This invention relates generally to pantograph jacks, and more particularly to a pantograph jack for lifting and lowering a vehicle chassis or the like.

2. Description of the Prior Art:

Generally, in prior art pantograph jacks, a load mounting stand and a base suppport are maintained in parallel with each other at the time of lifting and lowering operations of the jack, and for this reson, the gear shaped portions are provided in opposing relation to each other for those ends of the left and right-hand arms which are pivoted to the load mounting stand as well as for those ends of the left and right-hand arms which are pivoted to the base support, with the aforementioned opposing gear shaped portions being in meshing engagement with each other, such that the rotating angles of the left and right-hand arms about their points pivoted to the load mounting stand and the base support may be equal.

Usually, however, the load acting on the load mounting stand has been both eccentric and inclined, and the greater the degree of eccentricity, the degree of inclined angles, or the amount of the load applied to the jack, the greater will be the pressure acting upon the contacting surfaces of the gear meshing portions.

Therefore, the pressure acting upon the gear portions should be minimized as much as possible, and, in addition, means for such pressure minimization should be as simple as possible.

However, with prior art pantograph jacks, the surfaces of the gear shaped portions of the arms in most cases have been provided simply as punched surfaces of a steel plate, such that for reducing the pressure upon the contacting surfaces, the thickness of the steel plate itself should be increased to an undesired degree. Another prior art attempt at a solution has been to separately prepare the gear shaped portions having a greater thickness, and then, secure such gear shaped portions to the tip portions of the arms.

In the former case, however, the entire thickness of the steel plate is increased to such a degree as to be less economical or to lead to an increase in weight, in the case where the arms have a U-shaped cross section. In the latter case, there results an increase in the degree of misalignment in the meshing portions as well as an increase in the number of parts required as well as in the necessary man-hours for assembly.

SUMMARY OF THE INVENTION

Therefore, it is an object of the invention to provide an improved pantograph jack for obviating the conventional drawbacks, wherein the gear shaped portions of the arms are made integral with the arms by using a relatively thin steel plate according to a sheet-metal forming technique.

BRIEF DESCRIPTION OF THE DRAWINGS

The foregoing and other objects, features and advantages of the invention will be apparent from the following more particular description of a preferred embodiment of the invention as illustrated in the accompanying drawings wherein.

DETAILED DESCRIPTION OF THE PREFERRED EMBODIMENTS

Figure 1:
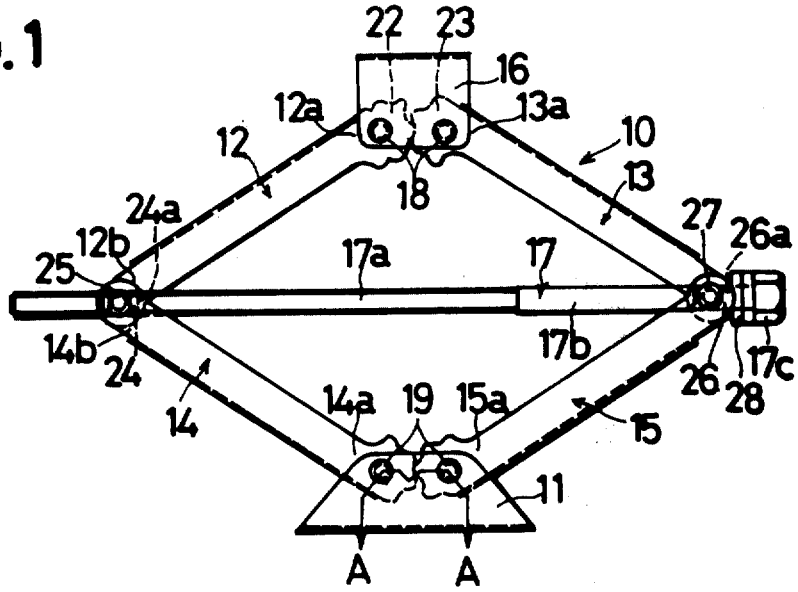
FIG. 1 is a front view of the device according to the present invention.
Figure 2:
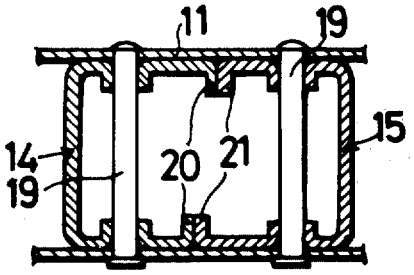
FIG. 2 is an enlarged cross-sectional view taken along the line A—A of FIG. 1.

Referring now to the drawings and particularly to FIGS. 1 and 2, there is shown a so-called pantograph jack 10 including a base support 11 on which the movable parts of the jacks are supported, a pair of upper arms 12 and 13, a pair of lower arms 14 and 15, a load mounting stand 16 on which is to be supported a part of the vehicle chassis, not shown, during the lifting and lowering operations, and a manually operated rod member 17 for lifting and lowering the stand 16 through the upper and lower arms 12, 13, 14 and 15.

Each upper end 12*a*, 13*a* of the upper arms 12, 13 is pivotally mounted on the stand 16 by means of pivot pins 18, 18 secured to the stand 16, while each lower end 14*a*, 15*a* of the lower arms is pivotally mounted on the base support 11 by means of pivot pins 19, 19 secured to the base support 11.

Figure 3:
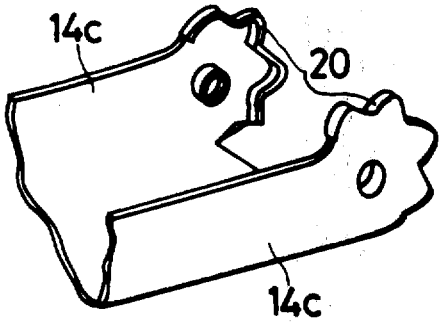
FIG. 3 is a perspective view of one arm of the jack according to the present invention.
Figure 4:
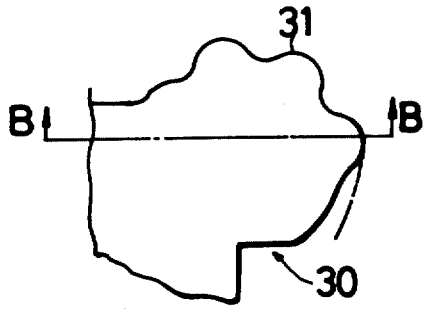
FIG. 4 is a part of a steel plate sheared to form a toothed portion thereof.
Figure 5:
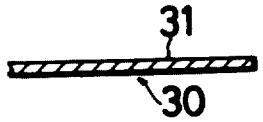
FIG. 5 is a cross-sectional view taken along the line B—B of FIG. 4.

The arms having generally U-shaped cross sections, as is shown particularly in FIG. 3.

In FIG. 3, there is shown, representatively, the lower end portion 14*a* of arm 14. The arm 14 includes a pair of opposed side walls 14*c*, 14*c*, each one having one end thereof provided with a flange portion 20, extending inwardly substantially at a right angle and having a gear toothed shape. Forming of this flange portion will be later described in detail.

Similar to such flange portions 20, 20, there are provided flange portions 21, 21 at the lower end 15*a* of the lower arm 15 such that these portions are in meshing engagement with portions 20, 20 of the arms 14, as viewed in FIGS. 2 and 1.

Also, similar to such flange portions 20 and 21, there are provided flange portions 22 and 23 at the upper ends 12*a*, 13*a* of the upper arms 12, 13, respectively, and in meshing engagement with each other.

The arms 12, 13, 14 and 15 of jack 10 are operated by the manually operated rod 17, having a screw threaded portion 17*a*.

The screw theaded portion 17*a* of the rod 17 operates within a screw threaded opening 24*a* formed in a nut 24. The nut 24 is provided at its opposite ends with a pair of pivot pins 25, 25, (only one is shown) pivotally connected with the lower end 12*b* of the lower arm 12 and the upper end 14*b* of the upper arm 14, respectively.

Numeral 26 designates a metal member similar to the nut 24, but provided with a smooth opening 26*a* for slidably supporting a smooth portion 17*b* of the rod 17. The metal member 26 is provided at its opposite ends with a pair of pivot pins 27, 27, (one is not shown), pivotally connected with the lower end 13*b* of the upper arm 13 and the upper end 15*b* of the lower arm 15. At the right end of the smooth portion 17*b* is provided a hexagon head portion 17*c* for receiving a manual jack operating handle member, not shown. In order to effectively rotate the manually operated rod 17, there is provided a thrust washer 28 between the hexagon head portion 17*c* of the rod 17 and the metal member 26.

Referring now to FIGS. 4 through 7, there is shown the process or method of forming the gear teeth shaped flange portion of the arms.

A thin steel plate 30 which is to be used as one of the arms of the jack is first sheared by a well known suitable shearing machine, not shown, to form an original toothed portion 31 at one end thereof. The toothed portion is not at this stage bent out to form a flange portion as is clearly shown in FIGS. 4 and 5.

Figure 6:
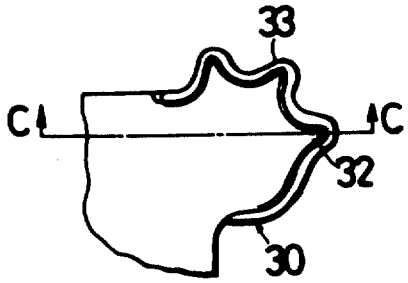
FIG. 6 is a view similar to FIG. 4, but showing a drawn toothed portion of the steel plate.
Figure 7:
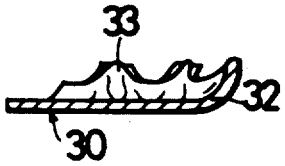
FIG. 7 is a cross-sectional view taken along line C—C of FIG. 6.

The thus formed toothed portion of the steel plate is then drawn inwardly at a predetermined portion apart from the outer circumference thereof to form a flange 32 bent inwardly substantially at a right angle. Thus, a roughly formed gear toothed portion 33 is formed at the flange portion of the steel plate itself, which is shown in FIGS. 6 and 7.

Finally, the roughly formed gear toothed portion is swaged to completely form the desired shaped gear teeth on the flange portion, which is shown for example in FIG. 3.

Using this procedure of making a toothed portion on the flange of the steel plate, it should be noted that the width of the flange may be desirably obtained, such as, for example, to have a width thereof being somewhat larger than that of the steel plate itself in order to strengthen the gear function of the tooth shaped flange.

In operation, when the hexagon head portion 17*c* of the rod 17 is rotated in the clockwise direction, as viewed in FIG. 1, the screw threaded portion 17*b* thereof then operates within the screw threaded opening 24*a* of the nut 24 to move the same to the right together with the upper and lower arms 12 and 14 through pivot pins 25, 25 secured thereto. At this time, the tooth shaped flanges 22 and 23 mesh with each other to move the load mounting stand 16 upwardly through pivot pins 18, 18, while the tooth shaped flanges 20 and 21 mesh with each other to rotate the lower arms 14, 15 about the pivot pins 19, 19, maintaining a parallel relation between the load mounting stand 16 and the base support 11.

When the hexagon head portion 17*c* of the rod 17 is rotated in the counterclockwise direction, then the nut 24 will move to the left to lower the load mounting stand 16 through the leftward movement of the upper and lower arms 12 and 14, in similar manner to the lifting operation thereof.

It should be noted that the load acting upon the load mounting stand 16 is generally eccentric and inclined such that the contacting surfaces of the tooth shaped flanges, which are in meshing engagement with each other, will be subjected to the pressure on their contacting surfaces. In this respect, the amount of pressure acting upon the contacting surfaces is dependent on the length of the tooth which is the width of the flange portion.

The gear toothed portion is formed on the flange portion of the arm or the thin steel plate by drawing such that the actual effective width of the gear toothed portion corresponds to the entire width of the flange minus curvature of the bending radius thereof.

As is apparent from the foregoing description in the arms of the pantograph jack according to the present invention, the gear toothed portions may be provided as flange surfaces extending at substantially right angle to the opposite side walls of the arms such that the entire weight of the arms may be reduced to a great extent. In addition, the gear toothed portions may readily be formed according to a known press forming technique resulting in lower manufacturing cost. Furthermore, the gear toothed portions may be formed in one piece with the arms as flange surfaces having desired widths thereof, such that the desired strength against the pressure acting thereupon may be easily obtained.

Obviously, many modifications and variations of this invention are possible in light of these teachings. It is to be understood therefore that within the scope of the appended claims, the present invention may be practiced otherwise than as specifically described herein.

I claim:

1. A pantograph jack for lifting and lowering a vehicle chassis or the like comprising:

a base support member on which movable parts of the jack are supported;

a load mounting stand positioned in parallel relation to said base support member for holding the load thereupon during the lifting and lowering operations of the jack;

a pair of upper arms, U-shaped in cross-section, each having one end thereof being rotatably mounted on said load mounting stand and having gear teeth provided upon opposite side walls of said U-shaped arms so as to face each other and on said one end thereof in meshing engagement with each other;

the other end of each of said upper arms being operated by a manually operated rod member;

a pair of lower arms, U-shaped in cross-section, each having one end thereof being rotatably mounted on said base support member and having gear teeth provided upon opposite side walls of said U-shaped arms so as to face each other and on said one end thereof in meshing engagement with each other;

the other end of each of said lower arms being operated by said manually operated rod member;

said gear teth of said lower and upper arms comprising integral flange portions extending only inwardly at substantially a right angle from, and formed about the periphery of, said opposite side walls of said one end of each of said arms; and the width of each flange portion, upon which said gear teeth are disposed, being greater than that of each opposite side wall of each of said arms.

* * * * *